US005553356A

United States Patent [19]

Locatelli et al.

[11] Patent Number: 5,553,356

[45] Date of Patent: Sep. 10, 1996

[54] DEVICE FOR DETECTING EXTRANEOUS CONDUCTING BODIES IN FIBRE BALES

[75] Inventors: Claudio Locatelli; Mario Mascheretti, both of Palazzolo Sull'Oglio, Italy

[73] Assignee: Fratelli Marzoli & C. S.p.A., Bergamo, Italy

[21] Appl. No.: 499,666

[22] Filed: Jul. 6, 1995

[30] Foreign Application Priority Data

Jul. 14, 1994 [IT] Italy ..... MI94A1471

[51] Int. Cl.[6] ..... D01G 31/00; D01G 7/06

[52] U.S. Cl. ..... 19/80 R; 19/0.2

[58] Field of Search ..... 19/0.2, 0.22, 65 A, 19/80 R, 81

[56] References Cited

U.S. PATENT DOCUMENTS

| | | | |
|---|---|---|---|
| 4,510,646 | 4/1985 | Locatelli et al. | 19/80 R |
| 4,707,887 | 11/1987 | Leifeld et al. | 19/0.2 |
| 4,805,266 | 2/1989 | Leifeld et al. | 19/0.2 |
| 4,993,117 | 2/1991 | Pinto et al. | 19/80 R |
| 5,090,090 | 2/1992 | Temberg et al. | 19/80 R |
| 5,123,144 | 6/1992 | Demuth et al. | 19/80 R X |

FOREIGN PATENT DOCUMENTS

| | | | |
|---|---|---|---|
| 0358891 | 7/1989 | European Pat. Off. . | |
| 3320059 | 6/1983 | Germany . | |
| 3436498 | 4/1986 | Germany | 19/80 R |
| 3936079 | 10/1989 | Germany . | |
| 5025713 | 2/1993 | Japan | 19/80 R |
| 1339178 | 9/1987 | U.S.S.R. | 19/80 R |

*Primary Examiner*—John J. Calvert
*Attorney, Agent, or Firm*—Diller, Ramik & Wight, PC

[57] ABSTRACT

An improved device for detecting extraneous conducting bodies in fiber bales processed in bale opening machines, comprising longitudinal shoes between which rotating beaters for withdrawing the fibers and grooved conveying wheels are inserted, and conductance sensors connected into an electrical circuit having one pole connected to the shoes and the other pole connected to said rotating members operating on the fibers and inserted in the gaps between the shoes.

7 Claims, 5 Drawing Sheets

DEVICE FOR DETECTING EXTRANEOUS CONDUCTING BODIES IN FIBRE BALES

This invention relates to automatic fibre withdrawal machines or so-called bale opening machines, which are known to represent the first stage in the processing of textile fibres contained in bales, with the task of automatically withdrawing fibres from the staple fibre bales and feeding them to subsequent processing. During the opening of the bales, and particularly if they contain natural fibres such as cotton or other fibres of vegetable origin, they may present a considerable content of extraneous matter. According to the current terminology used in this field, such extraneous matter is known as trash to indicate all residual impurities from ginning, such as stalk, leaf and seed fragments, dust to indicate heavy dust consisting mainly of earth, and microfibre to indicate very short broken fibres, in addition to fragments of straps or other binding or packaging elements. The material is arranged for cleaning and discarding impurities from the initial opening of the bale.

Of such extraneous matter metal bodies are of particular importance, for example pieces of binding straps, pieces or components of agricultural implements or packaging or handling machines. These metal bodies can give rise to problems of various kinds, such as clogging of the withdrawal machine ducts, blocking of moving parts, or damage to beaters or the separation equipment, however the greatest danger is connected with the fact that the possible impact between said bodies and the machine members can cause sparks. Staple textile fibres, such as cotton, are extremely flammable, and such sparks can trigger large fires which propagate with extreme speed and are very difficult to circumscribe and control.

To better clarify the technical problems confronted by the present invention and their resultant solution, FIGS. 1 and 2 show the operating scheme of a bale opening device of travelling projection type, to which the present invention constitutes an improvement. FIG. 1 is a cross-section through the working arm of the machine and FIG. 2 is its plan view.

In accordance with this operating scheme, the bales 1 are located side by side on the floor 2 to form a working surface for the bale opening machine, which consists of a tower frame, not shown in the figures, moving horizontally forwards and backwards within the plane of FIG. 1 along a longitudinal guide. This frame carries a projecting cutter or beater arm which extends onto the surface of the fibre bales to be opened and comprises the following main members:

- a suction hood 3 which upwardly conveys the fibres withdrawn from the bales 1; in a preferred version of the machine the lower edges of the hood extend downwards into proximity with the bale working surface;
- one or more beaters 4 rotating at high speed and provided with a plurality of teeth 5 which come into contact with the fibres, to withdraw them from the working surface of the aligned bales 1 and present them to the hood 3; in a preferred version of the machine the teeth 5 of the beaters 4 are offset along the axis of rotation of the beater so as to involve a discrete strip of the working surface of the fibre bales 1 to be opened;
- a series of parallel bars 6 which bear on the working surface to form the support on said surface for the entire described projecting arm assembly with its fibre withdrawal members. In this respect the projecting arm is able to move in the vertical direction relative to its support frame, with suitable travel stops. As can be seen from FIG. 2, which represents a plan view of the machine arm, the bars 6 alternate with the rotating members of the beaters 4 and do not interfere with them. In a preferred embodiment of the machine said bars comprise a portion which is not parallel to the direction of movement, so that the entire bearing surface is exposed to their passage. The toothings 5 of the two beaters 4 are hence axially offset, to thus involve the entire working surface of the bales;
- a pair of rollers 7 rotating in the direction of movement of the arm, they being grooved in the direction of their axis of rotation and positioned external to the ends of the hood 3 and external to the beaters 4. At each reversal of arm movement the drive for the conveying rollers reverses their direction of rotation. That roller which precedes the beaters rotates in such a manner as to convey the fibres into the region of action of the beaters.

The rollers 7 are carried by the beater arm during its horizontal movement such that they precede and follow the beaters 4 respectively, but can move freely vertically to it while resting under their own weight on the bale working surface, between an upper travel stop and a lower travel stop. They can hence sink to a greater or lesser extent into the fibres according to the consistency of the bales being worked and depending on whether they precede or follow the beaters. The rotational speed of said rollers is much less than that of the beaters and is generally higher than the traversing speed of the beater arm but of the same order of magnitude;

- the entire projecting arm and its members are contained within a framework 8.

Italian patent No. 1151589 in the name of the present applicant describes a device for detecting the presence of electrically conducting metal materials in fibre bales under working, which comprises conductance sensors associated with the bearing bars 6 of the bale opening machine beater arm. Said conductance sensors form part of an electrical sensing circuit, the two poles of the circuit being connected to the even and odd numbered bars alternately. For example all the even bars are connected to the negative pole and all the odd bars to the positive pole. When a conducting body present in the bale being worked causes a conductance increase between two adjacent bars, said electrical circuit senses this increase and consequently halts the process to enable the operators to remove the metal body. After removal the process is restarted.

The technical solution represented by Italian patent 1151589 is satisfactory for detecting conducting bodies having a discrete dimension and hence causing a substantial disturbance in the isolation between adjacent bars, which are a few centimeters apart. The device is not sensitive to bodies of length significantly less than this dimension or lying parallel to the bars.

The object of the present invention is to provide more effective monitoring of the presence of conducting materials even of small dimensions and a bale opening machine of improved characteristics. The advantages and characteristics of the improved bale opening machine of the present invention will be more apparent from the description of a typical embodiment thereof shown in FIGS. 4 to 5*b*. In its essential lines the bale opening machine according to the invention uses the already described operating scheme but with the following improvements.

The following is a detailed description of embodiments of the present invention taken in conjunction with the accompanying drawings.

In the Figures.

Figure 1:
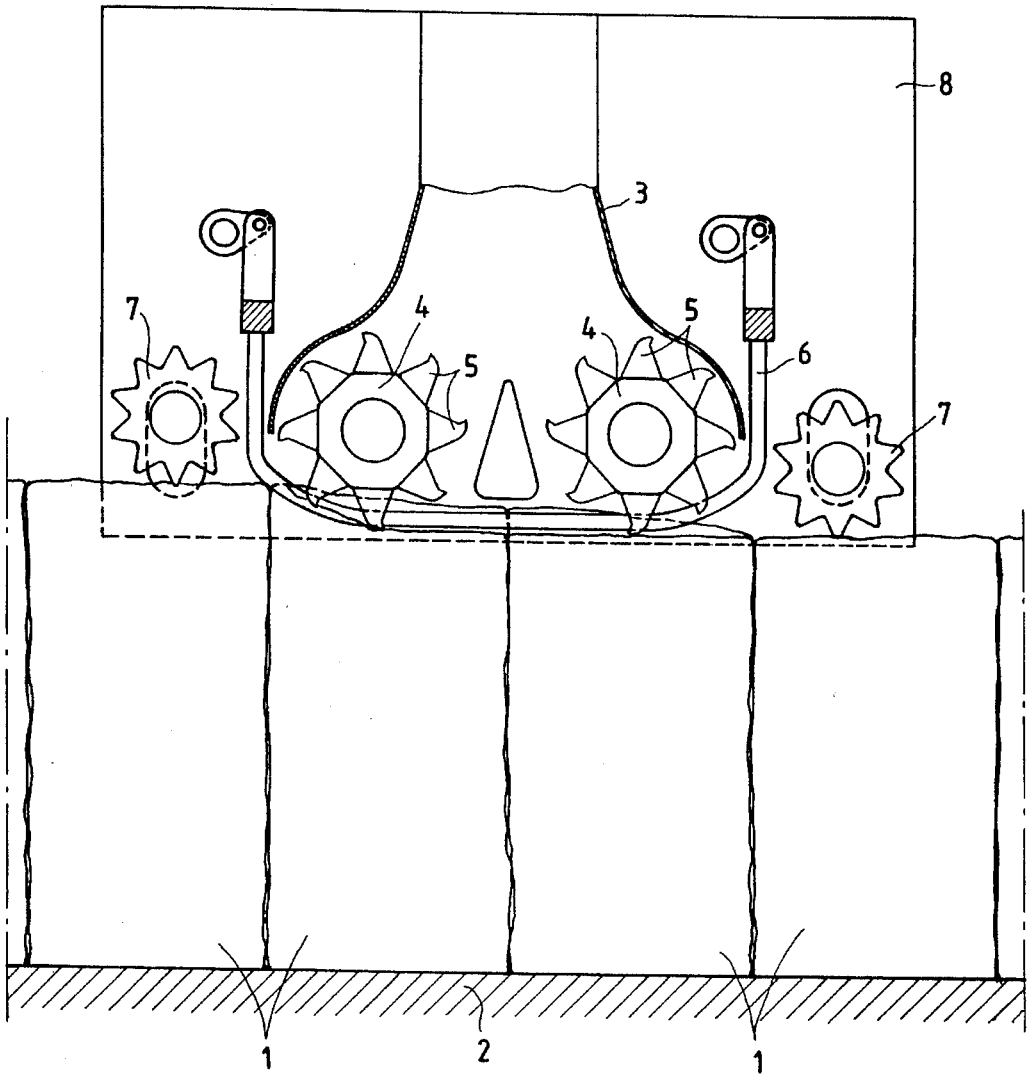
Fig.1 (PRIOR ART)
FIG. 1 is a schematic view of an opening device according to the prior art.
Figure 2:
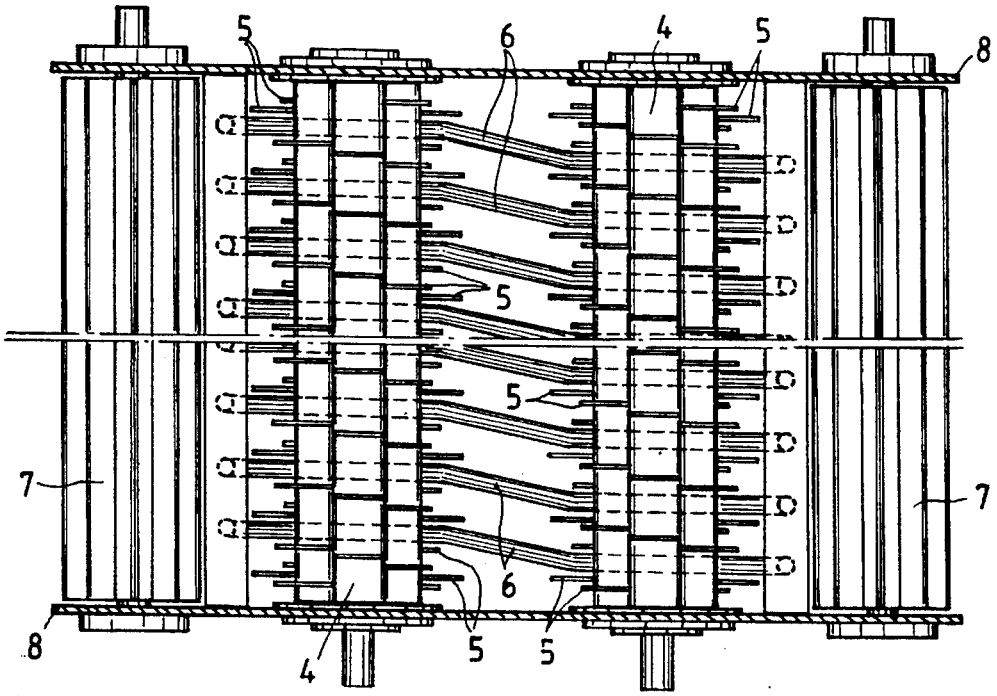
Fig.2 (PRIOR ART)
FIG. 2 is a cross section of an opening device according to the prior art.

The bearing bars are replaced, according to the present invention, by shoes 16 which extend as far as the region comprising the conveying rollers by which the fibres from the bale working surface are conveyed into the region of action of the beaters, and possibly beyond them.

Again, the function of the conveying rollers located on the two sides of the beaters 4 is now performed, according to the present invention, by a series of wheels 17 grooved in the direction of their axis of rotation, or by toothed discs, carried by the shafts 18 to operate in the gaps between the shoes 16. One or more wheels 17 of different axial dimension can be located in each gap between the shoes 16 on the shaft 18.

The poles of the electrical conductivity sensing circuit are, according to the present invention, connected respectively as follows:

all the shoes 16 to one pole, and to the other pole, all or part of the rotating members operating on the fibres and inserted into the gaps between the shoes, namely the conveying wheels 17 and, according to a preferred embodiment of the present invention, also the beaters 4. The characteristics and advantages of the bale opening machine according to the present invention will be more apparent from the description of the operation of a typical embodiment thereof given by way of non-limiting example with reference to the schematic representations of FIGS. 3 to 5, of which FIG. 3 is a cross-section through the arm of the machine, FIG. 4 is its plan view, and FIGS. 5*a/b* are its plan view including the device for detecting extraneous conducting bodies.

Figure 4:
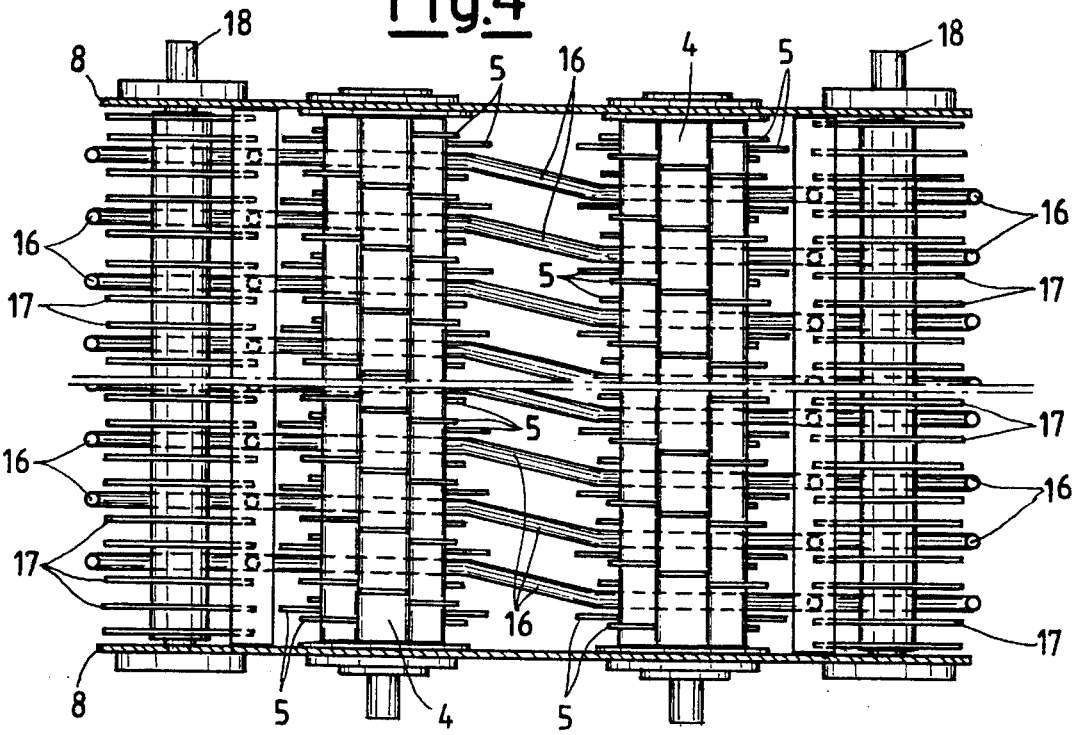
FIG. 4 is a cross section of a part of the opening device milling head.
Figure 3:
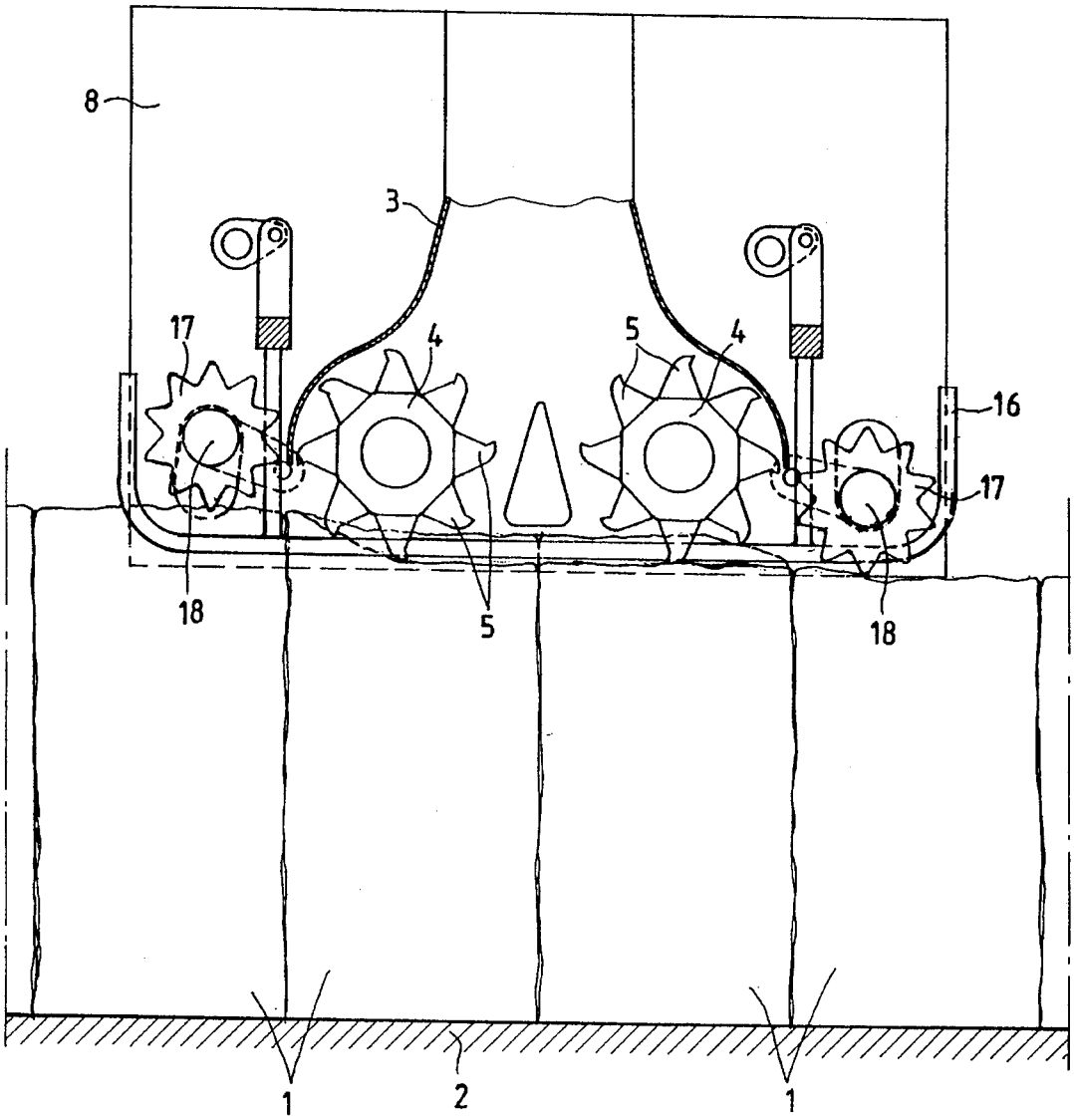
FIG. 3 is a schematic view of an opening device for fibre bales according to the present invention.

As can be seen from FIGS. 3 to 5, the shoes 16 are positioned to alternate with the rotating members of the beaters 4 and also with the grooved or toothed disc conveying wheels 17, and do not interfere with them. The series of discs or wheels 17 positioned on each side of the beater arm can sink to a greater or lesser extent into the fibres, depending on their consistency and whether they precede or follow the beaters.

Figure 5A:
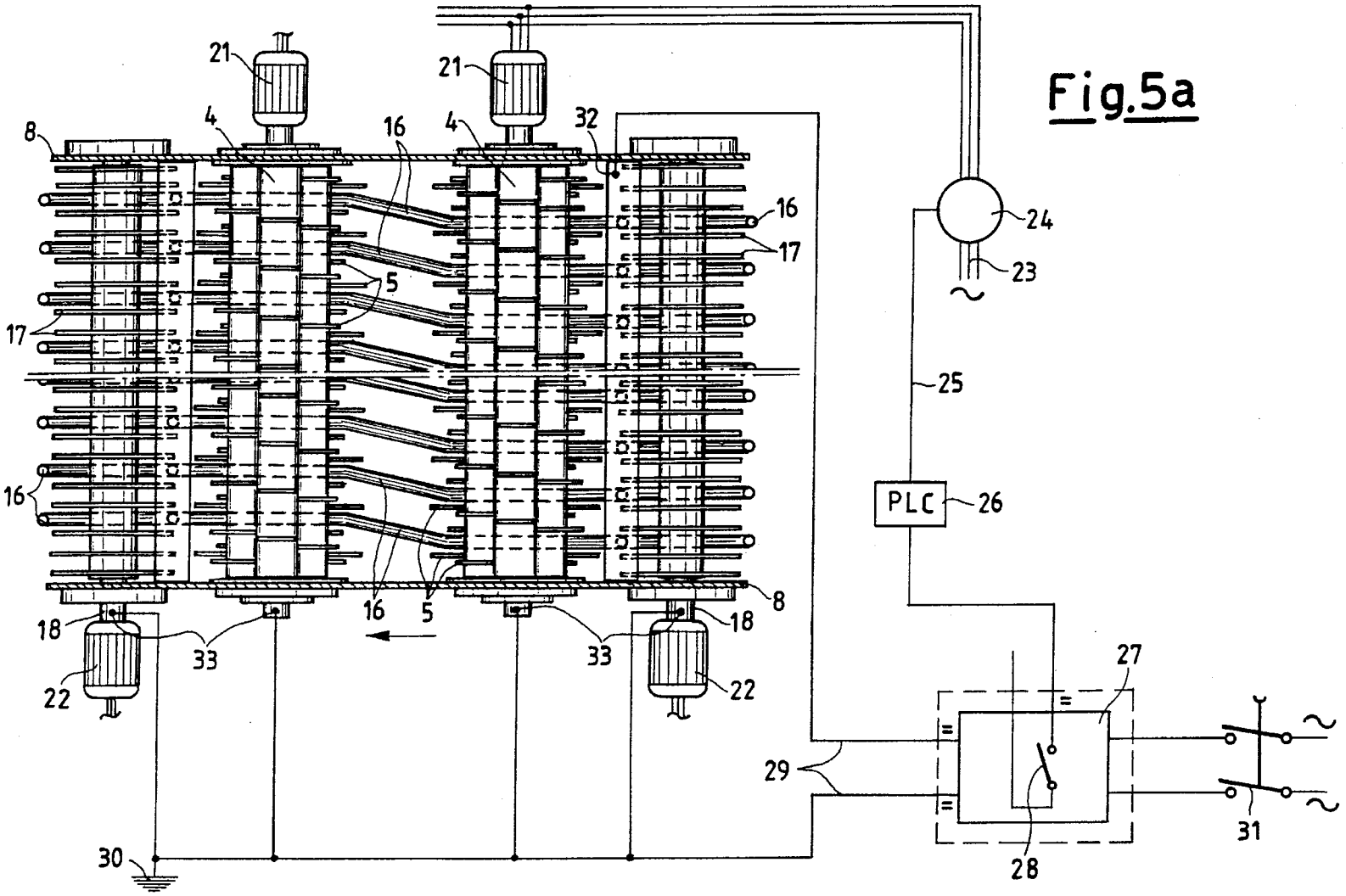
FIG. 5*a* is cross section of a part of the opening device including the detecting circuit in open position.
Figure 5B:
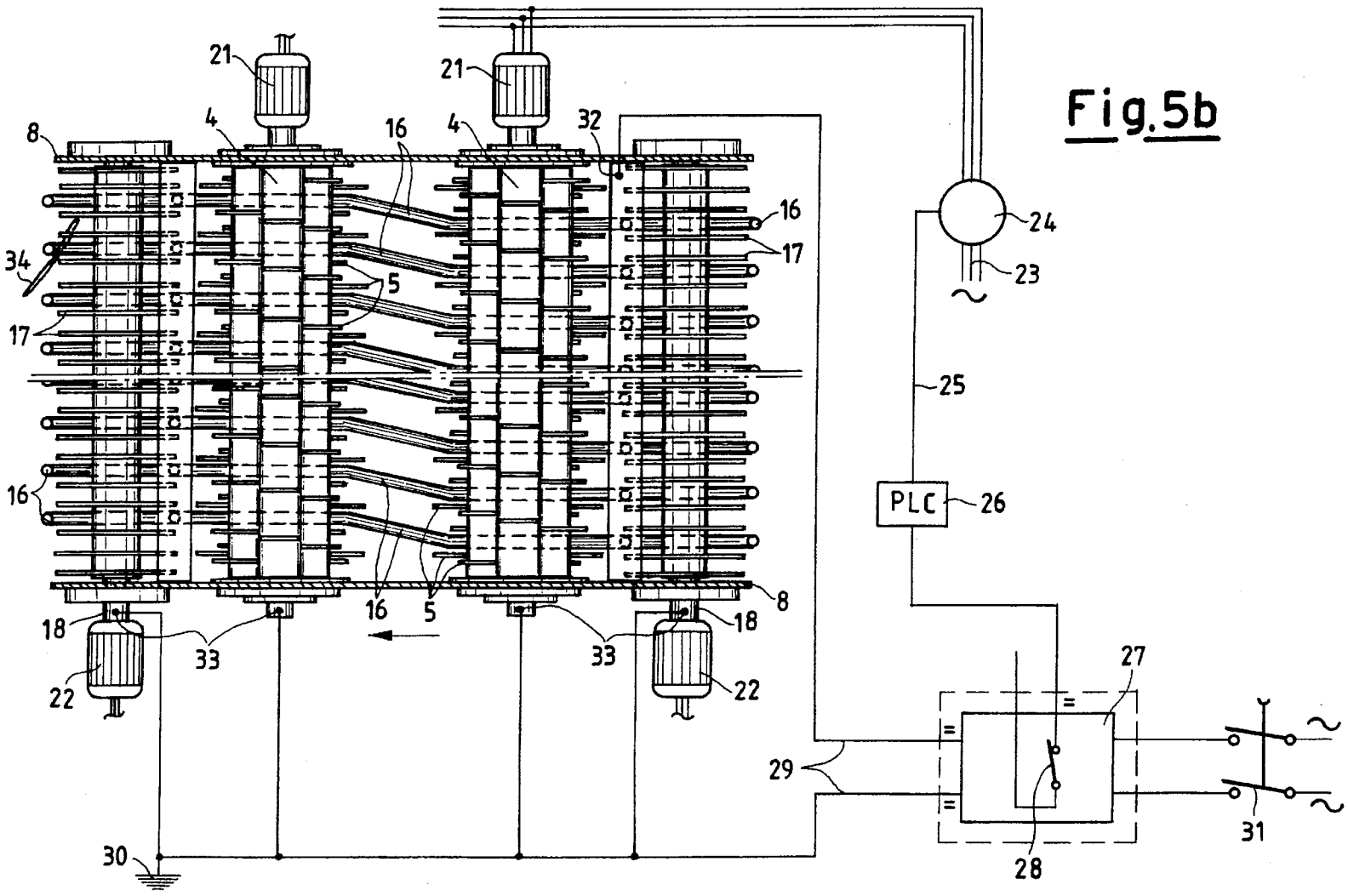
FIG. 5*b* is a cross section of a part of the opening device with the detecting circuit closed.

FIGS. 5*a* and 5*b* show by way of non-limiting example one embodiment of the detection system according to the invention, using a known electrical scheme of general type adapted to the specific detection requirements.

FIGS. 5*a* and 5*b* schematically show the beaters 4, each driven by a self-braking motor 21. The motion of the shafts 18 carrying the conveying wheels 17 can be derived either from a common motor or from separate motors 22. According to a preferred embodiment of the invention the drive motors for the rotating machine members are self-braking motors. In FIGS. 5 the circuit is shown for simplicity reasons as merely connected to just one of the motors 21, however it should be noted that all the machine operating motors are, or can be, cut out by the described circuit or operated by it. A suitable mechanical connection, for example of belt/pulley or gear type, can be inserted between the motors and shafts of the rotating members to establish correct torque and speed transmission between the parts. On the drawings the shafts and motors are shown as directly connected together for simplicity.

A remote control switch 24 is connected into the alternating current power line 23 to the motor 21 and is controlled by a direct current branch 25 into which a PLC (program logic computer) 26 and a control centre 27 powered with 110 V alternating current are connected. The power supply is converted to 24 V direct current in the control centre 27 and is fed to the secondary circuits.

The control centre 27 comprises a switch 28 which remains open while a potential difference exists between the beater/wheel assembly and the shoes 16, and which closes as a result of current passage between these two parts.

When the contact 28 closes, the PLC is powered to interrupt supply to the motor 21 by opening the remote control switch 24. The PLC 26 also controls all the other programmed operations on closure of the circuit for detecting conducting bodies in the cotton bales. The control centre 27 powers with direct current a second circuit 29 in parallel with 25. One branch of the circuit 29 is connected to earth at 30; a common switch 31 is located at the entry to the control centre 27.

The two branches of the circuit 29 are connected respectively to electric contacts 32 which connect together all the shoes 16, and 33 which connect together the beaters 4 and the rotating shafts 18 carrying the conveying wheels 17. The rotating members 4 and 18 connected to the contact 33 are connected to earth at 30. The shoes 16 connected to the contact 32 are connected to that branch of the circuit 29 connected to the positive pole of the d.c. voltage provided by the control centre 27. The shoes 16 are constructed of electrically conducting material and are installed on the machine in a manner electrically insulated from their supports. The same applies to the rotating members comprising the beaters 4 with their teeth 5 and the wheels 17 with their shafts 18.

It is apparent that a potential difference equal to that of the control centre 27 is established between the shoes 16 and said rotating members.

The control centre 27 is set to maintain the switch 28 (FIG. 5*a*) open when there is low conductance or very high resistance between the contacts 32–33, the dry textile fibres, such as cotton, being an electrically insulating material.

The device operates as follows. During normal machine working, the shoes 16 bear on the bale working surface to press on it with constant pressure. This pressure is determined on the basis of the fibre density, which generally varies during the consumption of the bale of material being worked. The pressure can be adjusted during working depending on the height of the working surface. It can be increased or decreased by suitable ballast or counterweights applied to the arm, or by equivalent pneumatic or hydraulic devices.

During normal working the motors 21 rotate the beaters 4 and the motors 22 rotate the shafts 18 with their grooved wheels 17. During the to-and-fro movement of the beater arm, the beater teeth 5 continuously remove staple fibre from the bale working surface, which as the operation proceeds becomes lower, with the result that the beater arm which rests on it is lowered with it. Provided that on the bale working surface or immediately below it, as in FIG. 5*a*, there are no conducting bodies such as a piece of iron wire, the control centre 27 maintains the contact 28 open as the insulation between the shoes 16 and wheels 17 or beaters 4 is good. The remote control switch 24 is closed and the motor 21 is powered, as are all other motors for the rotating parts. When, as in FIG. 5*b*, a conducting body such as a piece of metal wire 34 is level with the bale working surface or just below it, the body 34 is intercepted—in all probability—by one of the shoes 16 and by one of the grooved wheels 17 which precede the beaters 4. The conductance between the contacts 32 and 33 increases, to allow current to pass through the circuit 29. This current is detected by the control centre 27 and when its set threshold is exceeded the control centre 27 opens its contact 28 to interrupt power to the motors 21 and to the motors for the beaters 4 and wheels 17.

An alternative embodiment of the invention comprises not only immediate stoppage of the beaters and of the horizontal traversing of the arm, but also automatic raising of the beaters or of the entire beater arm and its casing 8, so as to allow the operator to immediately inspect and gain access to that part of the bale working surface in which-the presence of the metal body has been detected. Sound and/or light alarm devices, enabling devices for the descent of the arm and devices for blocking the motor 21 when the arm is raised can also be provided, in accordance with safety and efficiency criteria.

The technical result of the present invention is substantial progress in detecting metal bodies contained in fibre bales, in terms both of efficiency and reliability.

The bearing effect of the shoes 16, which slide horizontally on the bale working surface to distribute the weight of the beater arm over a greater surface, and precede at a greater distance the beaters 4 which represent the member mostly in danger if metal bodies are present, provides greater reliability to the detection device of the present invention.

Again, the specific pressure with which the wheels 17 bear is much higher than that of the rollers 7 of the known art, in that the surface area on which they bear their weight is much smaller. The grooved wheels 17 can hence scan the working surface at greater depth.

The greatest improvement provided by the present invention derives from the much smaller distance between the elements connected to the opposite poles of the detecting circuit, this distance being reduced from a few centimeters to a few millimeters. Because of the fact that the shoes 16 have a central deviation, the entire working surface is scanned by the sensors. It can also be seen that whereas the device of Italian patent 1151589 is unable to detect a metal body lying parallel to the shoes and to prevent it coming into contact with the beaters, the wheels 17 are positioned to precede the beaters, with good probability of deviating any parallel positioned body and causing it to form a conducting bridge between the wheels and shoes before it is encountered by the beaters.

In this respect it must be noted that the beaters 4 have to rotate at high speed and any collision with metal bodies can cause sparks, whereas the rotational speed of the wheels 17 is much lower and the linear velocities concerned are such as not to give rise to sparks, which could trigger a fire. It is also interesting to note that by suitably setting the sensors, the presence of electrically conducting bodies can be detected even before they make contact with the shoes 16 and wheels 17. Their mere proximity allows an already measurable current to pass. Action can therefore be taken before the metal body comes into contact with the machine members. This is particularly important should the metal body have passed close to the wheels 17 without effect, and the rotating member now in danger of contact is one of the beaters.

The provision of the extended shoes 16 and the wheels 17 for conveying and leading the fibres to the beaters is considerably advantageous technically in terms of productivity and efficiency of the bale opening machine, because of the equalization of the bale working surface before withdrawal by the beaters.

We claim:

1. A device for detecting extraneous conducting bodies in fibre bales processed in bale opening machines provided with a beater arm undergoing to-and-fro travel strokes along the bale working surface, comprising:

a suction hood (3) which conveys the withdrawn fibres;

one or more beaters (4) rotating at high speed and provided with teeth (5) which withdraw the fibres from the bale working surface;

a series of parallel bars which bear on the bales being worked and move in a traversing direction of the beater arm, and being positioned alternating with the rotating beaters (4);

a pair of rotating fibre conveying members positioned external to the beaters (4);

conductance sensors connected into an electrical circuit arranged to halt the device;

wherein the bearing bars consist of shoes (16) which extend longitudinally into a region containing the rotating members for conveying the fibres, the rotating conveying members consisting of grooved wheels or toothed discs (17) operating in gaps between the shoes (16), the electrical conductance measuring circuit being connected with one pole to the shoes (16) and with the other pole to rotating members operating on the fibres and inserted into the gaps between the shoes.

2. A device for detecting extraneous conducting bodies in fibre bales processed in bale opening machines as claimed in claim 1, wherein the poles of the electrical conductance measuring circuit are connected one to the shoes (16) and the other to the conveying members (17) and to the beaters (4).

3. A device for detecting extraneous conducting bodies in fibre bales processed in bale opening machines as claimed in claim 1, wherein the poles of the electrical conductance measuring circuit are connected one to the shoes (16) and the other to the conveying members (17).

4. A device for detecting extraneous conducting bodies in fibre bales processed in bale opening machines as claimed in claim 1, wherein the shoes (16) extend longitudinally beyond the fibre conveying members (17).

5. A device for detecting extraneous conducting bodies in fibre bales processed in bale opening machines as claimed in claim 1, wherein the shoes (16) comprise a portion out of parallel to the direction of movement so that the entire bearing surface on the working surface of the bales (1) is exposed to the passage of the shoes (16) in order to detect the presence of metal bodies.

6. A device for detecting extraneous conducting bodies in fibre bales processed in bale opening machines as claimed in claim 1, wherein a single wheel (17) is located within each gap between the shoes (16).

7. A device for detecting extraneous conducting bodies in fibre bales processed in bale opening machines as claimed in claim 1, wherein several wheels (17) are located within each gap between the shoes (16).

* * * * *